United States Patent [19]

Vasilantone

[11] 4,307,695

[45] Dec. 29, 1981

[54] ROTARY ENGINE

[76] Inventor: Michael Vasilantone, 34 Columbia Rd., Somerville, N.J. 08876

[21] Appl. No.: 98,413

[22] Filed: Nov. 28, 1979

[51] Int. Cl.[3] ..... F02B 57/02; F02B 47/10

[52] U.S. Cl. ..... 123/559; 123/43 R; 123/44 C; 123/44 D; 123/568; 91/495; 60/624

[58] Field of Search ..... 123/44 D, 568, 559, 123/43 R, 44 R, 44 C; 60/597, 598, 624; 91/491, 493, 494, 495

[56] References Cited

U.S. PATENT DOCUMENTS

| | | | |
|---|---|---|---|
| 1,243,494 | 10/1917 | Dunning | 91/495 X |
| 1,440,956 | 1/1923 | Ballenger | 123/568 |
| 3,084,562 | 4/1963 | Fitzpatrick | 91/495 |
| 3,168,082 | 2/1965 | De Villiers | 123/44 D |
| 3,425,402 | 2/1969 | Reisacher | 123/568 |
| 3,739,756 | 6/1973 | Villella | 123/44 D X |
| 3,807,373 | 4/1974 | Chen | 123/568 X |
| 3,921,601 | 11/1975 | Maoz | 123/44 D X |

*Primary Examiner*—Michael Koczo, Jr.
*Attorney, Agent, or Firm*—Baker & McKenzie

[57] ABSTRACT

Disclosed is a rotary engine comprising a rotor, a plurality of pistons angularly mounted in the rotor, an actuator mounted for eccentric rotation relative to the axis of rotation of the rotor, a blower, a transverse actuator pin connecting each piston to the actuator, and a plurality of fixed pins connecting the rotor to the actuator. The fixed pins are mounted on the rotor, pass through clearance holes in a rotor disc which acts as a blower, and carry extension gears which mate with internal gears mounted in the actuator. Accordingly, rotation of the rotor causes rotation of the blower and of the actuator.

8 Claims, 6 Drawing Figures

ROTARY ENGINE

TECHNICAL FIELD

This invention relates to rotary engines. In particular, it relates to rotary engines having blower and/or superchargers which are driven by the rotary engine.

BRIEF SUMMARY OF INVENTION

The invention is a rotary engine comprising a rotor, a plurality of pistons angularly mounted in the rotor, an actuator mounted for eccentric rotation relative to the axis of rotation of the rotor, a blower, a transverse actuator pin connecting each piston to the actuator, and a plurality of fixed pins connecting the rotor to the actuator. The fixed pins are mounted on the rotor, pass through clearance holes in the blower, and carry extension gears which mate with internal gears mounted in the actuator. Accordingly, rotation of the rotor causes rotation of the blower and of the actuator.

The working face of each piston contains an asymmetric indentation which causes the force of the expanding gas to push the piston transversely as well as longitudinally. Although there are forces from combustion that exert pressure in all directions within each combustion space, these forces eventually follow a path of least resistance. Accordingly, the eventual work is less down the piston arm (that is, longitudinally of the piston) and more towards the rotation line (that is, transversely of the piston and in the direction of rotation of the rotor). This phenomenon is, of course, largely perpetuated by the on-going rotational movement.

A conventional engine "sees" each piston at a dead standstill prior to combustion, so that the pressure line (or pressure to ground) is largely straight down the piston to the arm, or rod. In contrast, with the subject invention the rotational force changes the pressure line in its direction and continues to move the pressure line more towards the direction of rotation as the rotational speed increases.

DETAILED DESCRIPTION OF THE PRESENTLY PREFERRED EMBODIMENT

Figure 3:
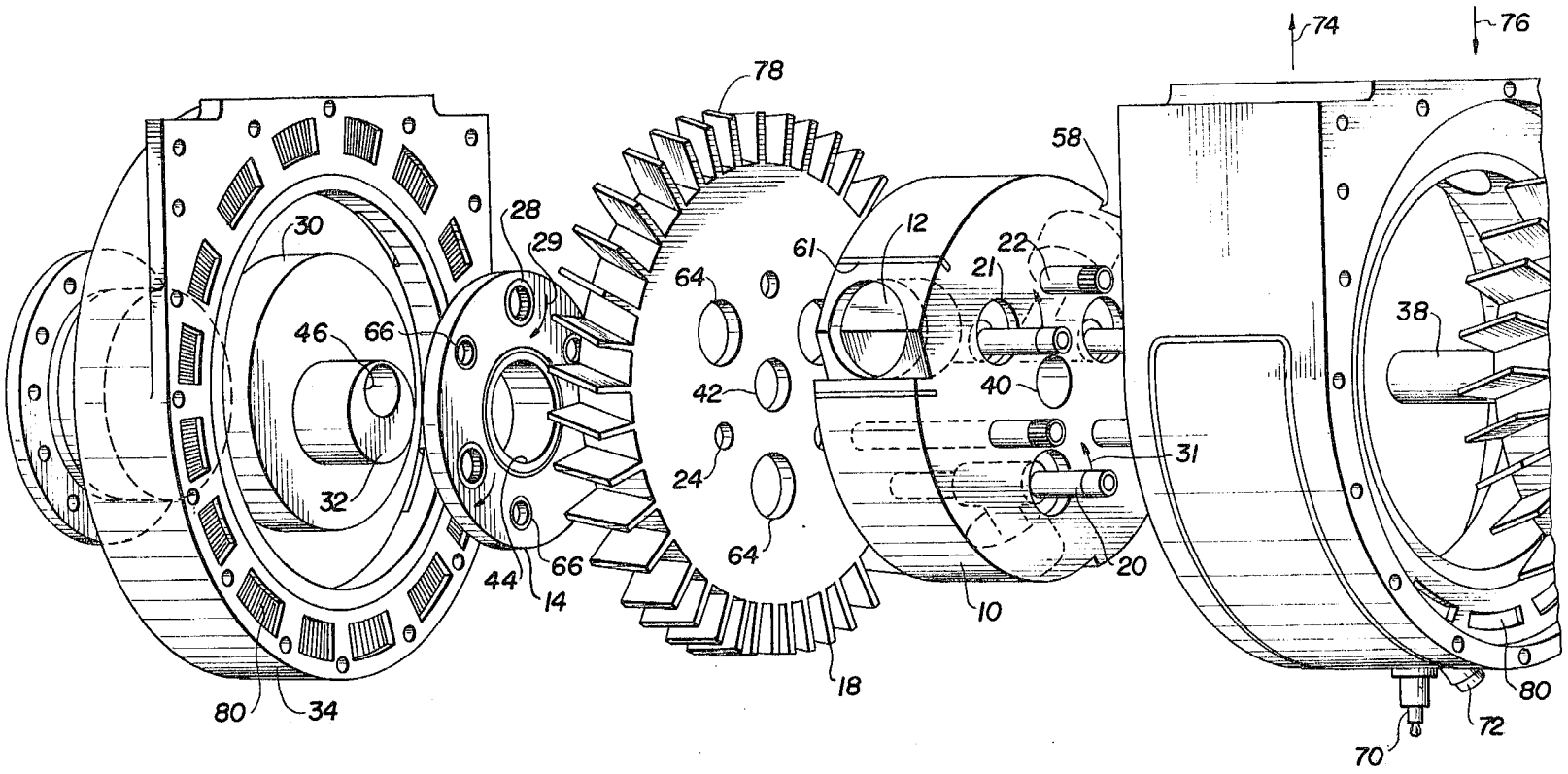
FIG. 3 is an exploded isometric view of the principal components of a rotary engine according to my invention.

An exploded view of the left half of the presently preferred embodiment (less the supercharger) is shown in FIG. 3. That is, there is a plane of symmetry through the element shown at the right, and there are elements which are the mirror images of the elements shown extending to the right, out of the drawing.

Figure 1:
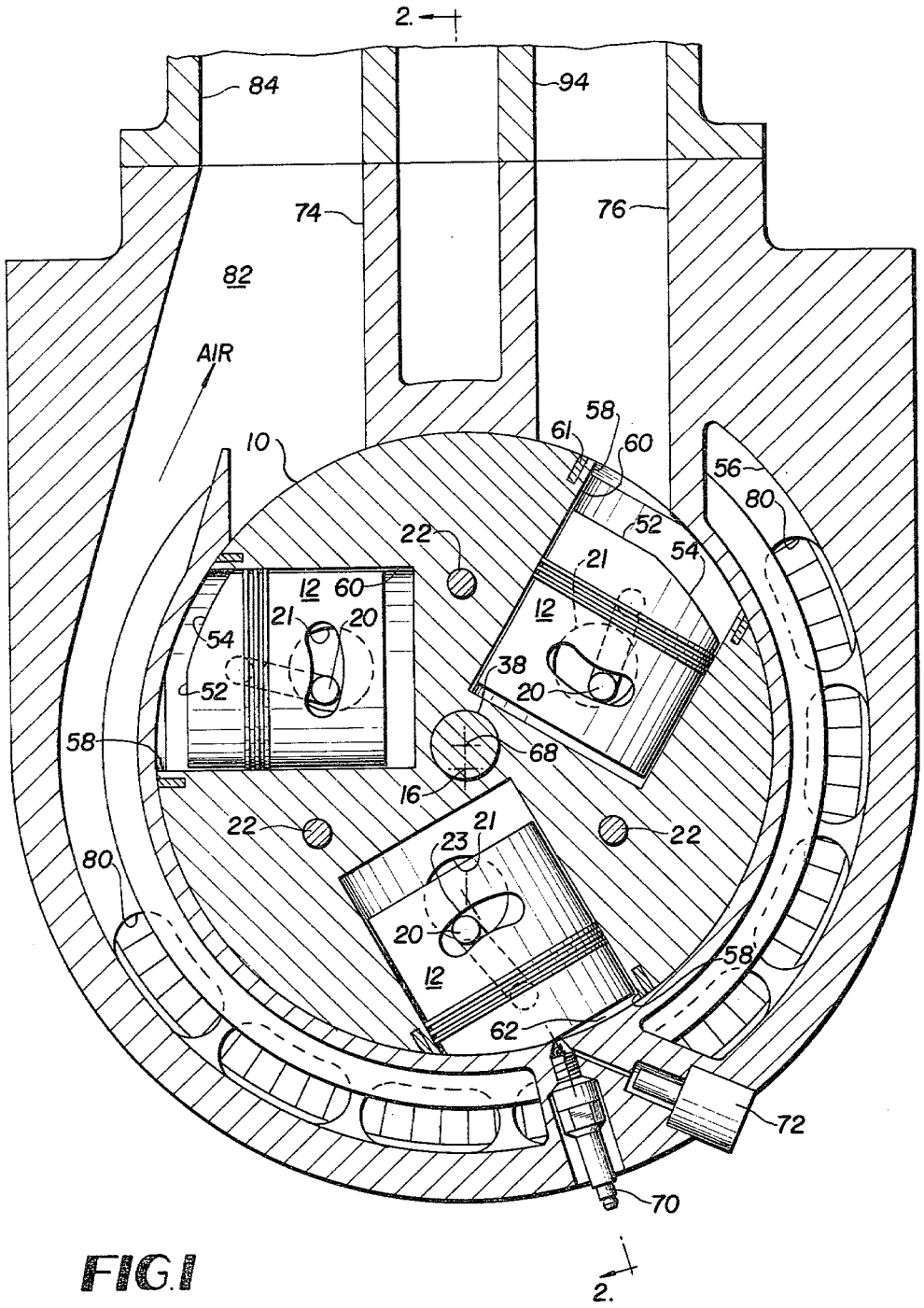
FIG. 1 is a cross-sectional view of the rotor and engine block of a rotary engine according to my invention.
Figure 2:
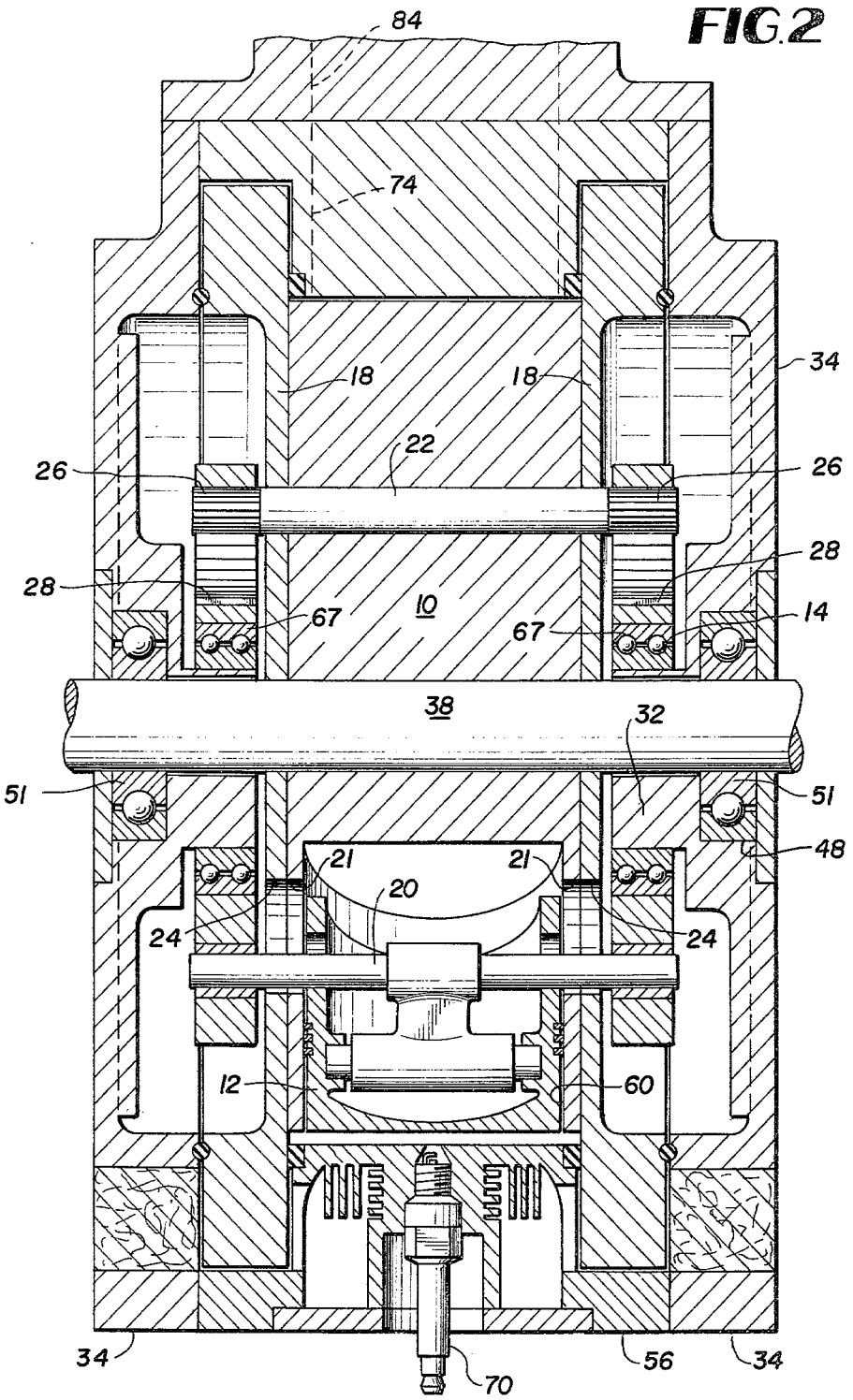
FIG. 2 is view along the line 2—2 in FIG. 1.

The rotary engine shown in the drawings comprises a rotor 10, three pistons 12 angularly mounted in the rotor 10, an actuator 14 mounted for eccentric rotation relative to the axis of rotation 16 of the rotor 10, a blower 18 in the form of a rotor disc, an actuator pin 20 exiting the rotor 10 via a hole 21 connecting each piston 12 to the actuator 14, and three fixed pins 22 mounted on the rotor 10 and passing through clearance holes 24 in the blower 18. As best seen in FIG. 2, extension gears 26 mounted on either end of the fixed pins 22 mate with internal gears 28 mounted in the actuator 14, permitting the fixed pins to rotate in the direction of the arrows 29 relative to the actuator 14 as the rotor 10 and the actuator 14 move relative to each other. That is, the extension gears 26 on the fixed pins 22, which are part of the rotor 10 or are fixed to the rotor 10, move against the internal gears 28 mounted in the actuator 14. This transmits combustion power to the actuator 14, which in turn guides the actuator pins 20 and their related piston 12 in a circumferential path relative to an actuator hub 32 (described hereinafter), providing reciprocal motion to the pistons 12 in relation to the rotor 10. As best seen in FIG. 1, the actuator pins 20 exit the rotor 10 via holes 21 in both walls of the rotor 10 and extend through clearance slots 23 in the pistons 12. As will be apparent, rotation of the rotor 10 causes rotation of the blower 18 and the actuator 14. The arrows 31 indicate the counterclockwise movement of the actuator pins 20 relative to the rotor 10.

The rotary engine further comprises a main bearing platform 30 on which the actuator hub 32 is eccentrically mounted, an end plate 34, and on at least one side of the engine, a power take-off device, such as the pulley 36. The actuator 14 contains a central hole 44 which accepts the actuator hub 32 for rotation thereabout. A main shaft 38 passes through a hole 40 in the rotor 10, a hole 42 in the blower 18, a hole 46 in the actuator hub 32, a bearing 51 mounted in a hole 48 in the main bearing platform 30, and a hole 50 in the pulley 36. The rotor 10 and the pulley 36 are mounted on the main shaft 38, so that rotation of the rotor 10 causes rotation of the pulley 36 via the main shaft 38. The holes 42, and 46, on the other hand, are clearance holes which permit the blower 18, the actuator hub 32, and the main bearing platform 30 to move circumferentially freely relative to the main shaft 38. As will be apparent, the three fixed pins 22 move in relation to the actuator 14 as their geared ends move captively about the internal gears 28.

The pistons 12 are each positioned at an angle pointing in the direction of travel. The faces 52 of the pistons 12 contain asymmetric indentations 54 curved to match the inner walls of the engine block 56, and the rotor 10 has extensions 58 of piston passageways 60 and lateral seals 61 which together create combustion spaces 62. During combustion the expanding gases push the rotor 10 in a clockwise direction in FIG. 1. As will be apparent, the force of the expanding gases push the pistons 12 in a linear direction that is relatively vertical (i.e., tangential) to the radius lines of the rotor 10, as well as pushing the pistons 12 downwardly in piston passageways 60 in the conventional fashion.

The actuator pins 20 pass through clearance holes 64 in the blower 18 and are tightly but rotatably received in holes 66 in the actuator 14. The actuator 14 rides on the actuator hub 32 via bearings 67, and its function is to follow the spin of the rotor 10, but on an axis of rotation 68 which is spaced from the axis of rotation 16 of the rotor 10 by a distance which is slightly less than the length of the radius of the actuator hub 32. This arrangement causes the pistons 12 to move in a different circle than the rotor 10, creating one reciprocal movement for each revolution of the rotor 10.

The inward stroke of each piston 12 starts at a spark plug 70 adjacent the primary gas injector 72. Combustion of the gases provides a power stroke during which each piston 12 rotates almost 180 degrees until its combustion space 62 comes into communication with an exhaust passage 74. Shortly after each combustion space 62 passes the exhaust passage 74, it comes into communication with intake passage 76, which supplies a mixture of gas, air, exhaust gas to the combustion space 62. From there back to the spark plug 70, the fuel vapors are compressed in preparation for ignition.

Figure 4:
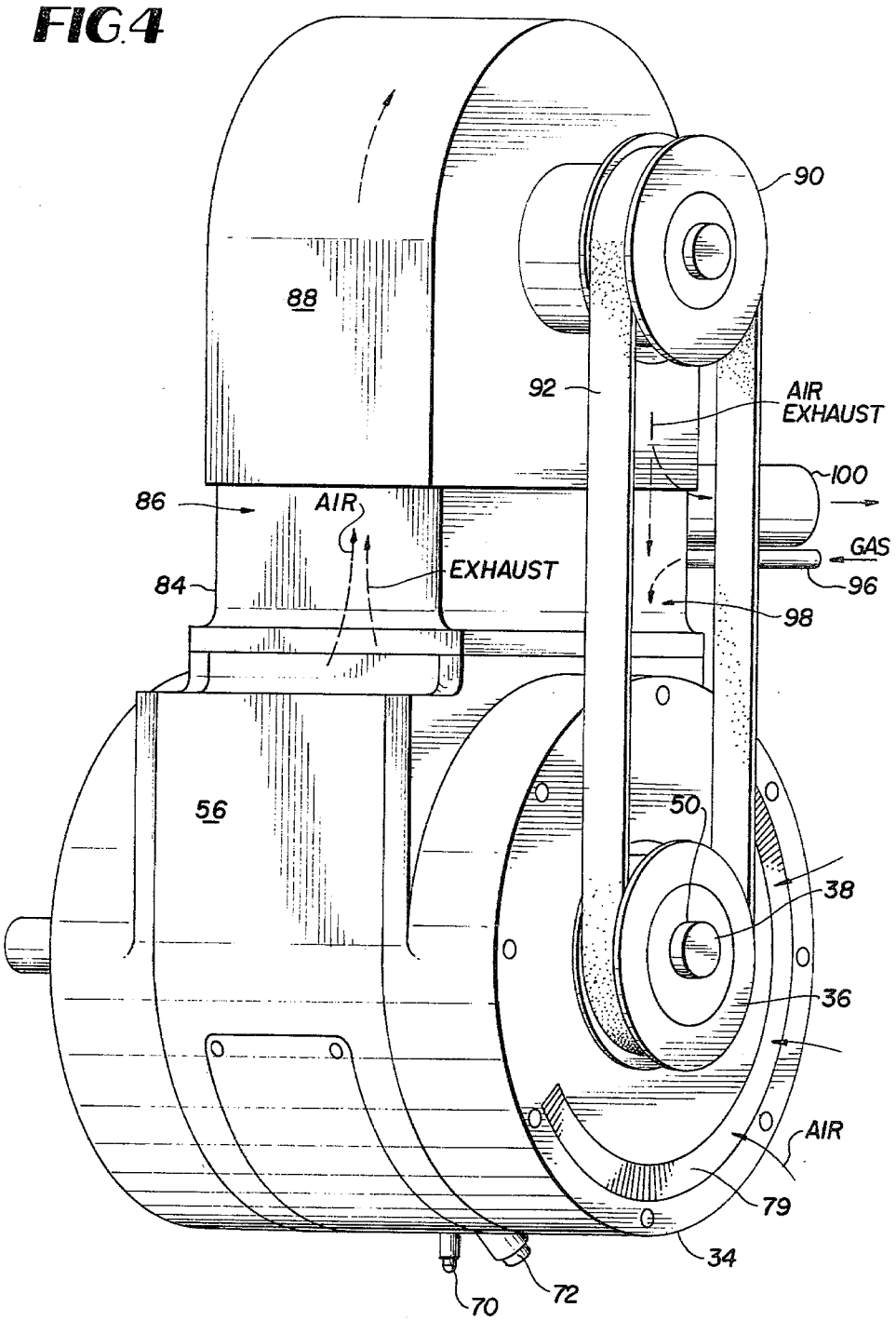
FIG. 4 is an isometric exterior view of a rotary engine according to my invention.
Figure 5:
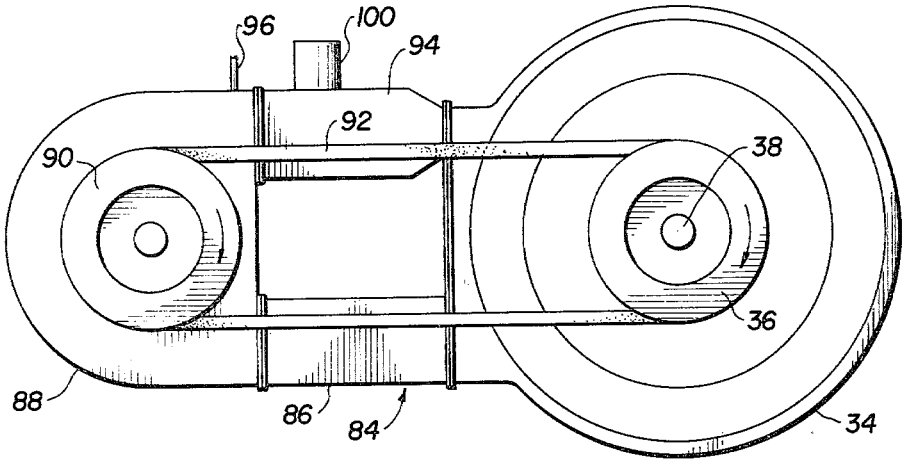
FIG. 5 is a side view of a rotary engine according to my invention.
Figure 6:
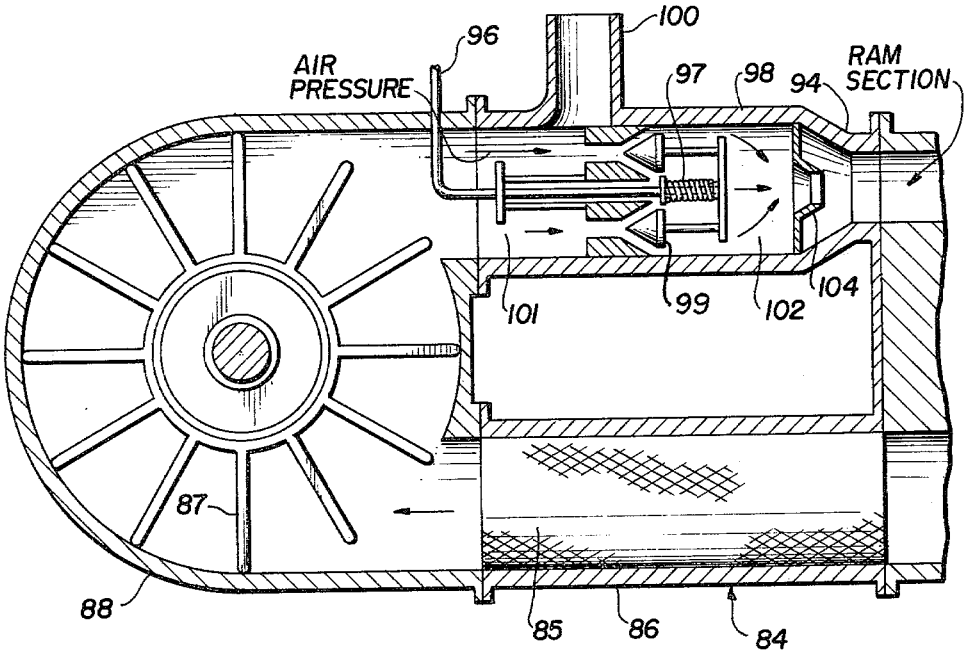
FIG. 6 is a cross-sectional view of a stabilizer according to my invention.

As the rotor 10 turns, the fanned peripheral area 78 of the blower 18 draws air through filter element 79 into the cooling air entry ports 80 and forces the air in a clockwise direction in FIG. 1. The air from the blower 18 unites with the exhaust gases in the exhaust passage 74 at 82, and the resultant gases are blown through filter tube 84 containing a filter 85 at 86 and into stabilizer impeller 87 contained in an impeller housing 88. As shown in FIG. 4, the stabilizer impeller 87 is keyed to a shaft 89 which is driven by a pulley 90, also keyed to the shaft 89, via a belt 92 trained over the pulley 36.

The mixture of air and exhaust gases in the exhaust passage 74 is rammed back into the intake passage 76 by the impeller 87 via a tube 94. A gas inlet 96 is provided in a carburation area 98 in the tube 94 to enrich the flow of gases, and an outlet 100 to atmosphere is provided in the tube 94 to exhaust a part of the air/exhaust gas mixture to atmosphere. The mixture of air and exhaust gas returned to the combustion spaces 62 by the stabilizer impeller 87 may be regulated by valving the gas inlet 96 via a compression spring 97 and pressure-actuated plungers 99 mounted in the carburation area 98 between a selector chamber 101 and a mixing chamber 102. Immediately downstream of the mixing chamber 102 is a muzzle 104, which acts a Venturi tube.

As will be understood, the stabilizer impeller 87 acts as a supercharger in that it receives the rush of exhaust gases from the engine and returns a portion of them to the engine while at the same time it is belted to or otherwise driven by the engine. This arrangement may be governed by a simple pulleyed means, as shown, or it may be more sophisticated, employing gears, clutches, or electronic selection.

It should be noted that little work is required to both super-charge and turbo-charge the engine, since all the movements of the rotor 10, the blower 18, and the stabilizer impeller 87 are in unison, though not synchronization. Also, little work is involved in the reciprocal movements of the piston 12, since their movement is largely concentric, although eccentric in relation to the rotation of the rotor 10.

CAVEAT

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

I claim:

1. A rotary engine comprising:

(a) a rotor mounted for rotation about a first axis;

(b) a plurality of pistons angularly mounted in said rotor;

(c) an actuator mounted for rotation about a second axis which is parallel to but eccentrically spaced from the first axis;

(d) a blower mounted for rotation about the first axis;

(e) a transverse actuator pin connecting each piston to said actuator; and (f) a plurality of transverse fixed pins (i) mounted on said rotor, (ii) passing through clearance holes in said blower, and (iii) having extension gears at the ends thereof which mate with internal gears mounted in said actuator, whereby rotation of said rotor causes rotation of said blower and of said actuator.

2. A rotary engine as recited in claim 1 wherein the working faces of said pistons contain asymmetric indentations which cause the force of the expanding gases to push the piston transversely as well as longitudinally.

3. A rotary engine as recited in claim 2 wherein said rotor is contained in an engine block and wherein said asymmetric identations are curved to match the inner walls of the engine block.

4. A rotary engine as recited in claim 3 wherein said asymmetric indentations lead to the edges of said pistons which are in the direction of rotation of said rotor.

5. A rotary engine as recited in claim 2 wherein said asymmetric indentations lead to the edges of said pistons which are in the direction of rotation of said rotor.

6. A rotary engine as recited in claim 1 and further comprising a supercharger driven by said rotor.

7. A rotary engine as recited in claim 1 wherein said rotor is contained in an engine block and said pistons are contained in piston passageways which open to the peripheral exterior of said rotor, the portion of said piston passageways between the radially outer faces of said pistons when at their radially outer positions and said engine block serving as combustion spaces, said rotary engine further comprising means for regulating the quantity of gas admitted to said combustion spaces.

8. A rotary engine as recited in claim 1 wherein said rotor is contained in an engine block and said pistons are contained in piston passageways which open to the peripheral exterior of said rotor, the portion of said piston passageways between the radially outer faces of said pistons when at their radially outer positions and said engine block serving as combustion spaces, said rotary engine further comprising:

(a) a supercharger driven by said rotor and (b) means for regulating the mixture of air and exhaust gas returned to said combustion spaces by said supercharger.

* * * * *